US005398920A

United States Patent [19]

Leu

[11] Patent Number: 5,398,920

[45] Date of Patent: Mar. 21, 1995

[54] PROCESS AND APPARATUS FOR DELIVERING PREFERABLY FOLDED PRINTING PRODUCTS TO A FURTHER PROCESSING POINT

[75] Inventor: Willy Leu, Pfaffikon, Switzerland

[73] Assignee: Ferag AG, Switzerland

[21] Appl. No.: 997,886

[22] Filed: Dec. 29, 1992

[30] Foreign Application Priority Data

Jan. 9, 1992 [CH] Switzerland ..... 00046/92

[51] Int. Cl.[6] ..... B65H 5/22

[52] U.S. Cl. ..... 271/3.1; 271/107; 271/212; 271/215; 271/216; 271/217

[58] Field of Search ..... 271/3.1, 107, 212, 150, 271/151, 215, 216, 217

[56] References Cited

U.S. PATENT DOCUMENTS

| | | | |
|---|---|---|---|
| 4,320,894 | 3/1982 | Reist et al. . | |
| 4,369,959 | 1/1983 | Hornbuckle | 271/212 X |
| 4,478,400 | 10/1984 | Commers | 271/212 X |
| 4,762,314 | 8/1988 | Harada | 271/212 X |
| 4,953,847 | 9/1990 | Honegger . | |
| 5,042,792 | 8/1991 | Honegger et al. . | |

FOREIGN PATENT DOCUMENTS

| | | |
|---|---|---|
| 489963 | 8/1938 | United Kingdom . |
| 1036346 | 7/1966 | United Kingdom . |
| 2205819 | 12/1988 | United Kingdom . |

*Primary Examiner*—H. Grant Skaggs
*Assistant Examiner*—Carol Lynn Druzbick

[57] ABSTRACT

By a first conveying device printing products are fed in an imbricated formation (S), in which each printing product rests on the following one, the fold edge of the folded products forming the trailing edge. The printing products are pushed into an intermediate stack from below. The respectively uppermost product of this intermediate stack is seized in the region of the fold edge by at least one sucker of a sucker arrangement, raised upward and brought into the conveying region (F) of a second conveying device. The latter has individually controllable grippers which are arranged at regular intervals, circulate along a closed path, seize the fold edges delivered by the sucker arrangement and convey away the printing products thus seized. By forming an intermediate stack, from which the printing products are then raised by the sucker arrangement at the desired rate and fed to the grippers, even imbricated formations (S) occurring with irregularities can be processed satisfactorily.

16 Claims, 9 Drawing Sheets

PROCESS AND APPARATUS FOR DELIVERING PREFERABLY FOLDED PRINTING PRODUCTS TO A FURTHER PROCESSING POINT

BACKGROUND OF THE INVENTION

The present invention relates to a process and an apparatus for delivering preferably folded printing products to a further processing point.

In the case of the apparatus of this type described in CH-A-630,583 and the corresponding U.S. Pat. No. 4,320,894, in the transfer region the fed printing products are pushed by the supply conveyor directly into the passing open grippers of the removal conveyor. In order to ensure correct seizing of the printing products, in the transfer region of the printing products the conveying direction of the removal conveyor runs from bottom to top and transversely to the conveying direction of the fed printing products. Although this measure means that allowance can be made for slight irregularities in the distances between successive printing products in the imbricated stream, too great a distance between two printing products within the fed imbricated formation has the effect that certain products arrive at the transfer region too late and consequently miss the assigned gripper, which then goes on empty to the further processing point. The following gripper then takes with it not only the printing product assigned to it but also that product which could not be taken along by the preceding gripper. It is consequently obvious that such an irregular incidence of printing products can have adverse effects at the downstream further processing point.

It is further known from EP-A-0,368,009 (and the corresponding U.S. Pat. No. 5,042,792) to convey against a stop printing products which are fed in pairs lying one on top of the other in an imbricated formation in which each product pair rests on the following product pair, then seize them in the region of the leading edge by a suction member and raise them in order to bring the corresponding printing product into the effective range of circulating driver elements, which raise the leading edges of the printing products further into the conveying region of a removal conveyor, which is formed by two interacting belt conveyors. With this known apparatus, the printing products lying one on top of the other in the fed imbricated formation can be detatched from one another and arranged to form a new imbricated formation in which all the products only overlap partially and no longer cover one another completely.

Nevertheless, in the case of this apparatus as well it is important that the packs of printing products in the fed imbricated formation are essentially at the same distances from one another, in order for undisturbed separating of the completely covering printing products to be possible.

The present invention is thus based on the object of providing a process and an apparatus of the type mentioned at the beginning which allow the printing products to be fed to a further processing point in the desired sequence irrespective of the quality of the fed imbricated formation.

SUMMARY OF THE INVENTION

The present invention resides in a process and apparatus for delivering printing products that are preferably folded to a processing point.

The apparatus, which carries out the process, includes a first conveying device for feeding the printing products in an imbricated formation in which each printing product rests on the following one. A second conveying device then takes over and further transports the printing products.

In accordance with the present invention the apparatus includes a stacking point which is arranged in the conveying region of the first conveying device. At the stacking point an intermediate stack is formed from the fed printing products, and the stack is charged or loaded from below. A sucker arrangement acts on the uppermost printing product of the stack and raises the respectively seized printing products from the stack. The sucker arrangement then delivers the seized printing product to a conveying region of the second conveying device.

Due to the fact that the fed printing products are first of all pushed into an intermediate stack, from which they are taken from the top by the sucker arrangement and fed to the second conveying device, the feeding of the printing products to the second conveying device is separated from the feeding of the printing products by the first conveying device. This means that excessively large or small distances between successive printing products and even missing printing products in the fed imbricated stream no longer influence the correct feeding of printing products to the second conveying device. Such irregularities in the incident imbricated formation are compensated for by the intermediate stack.

In addition, it is also possible if need be to stop temporarily the feeding of printing products to the second conveying device by deactivating the sucker arrangement, without the delivery of printing products by the first conveying device having to be interrupted.

Preferred further developments of the process according to the invention and of the apparatus according to the invention are described below.

BRIEF DESCRIPTION OF THE DRAWINGS

Exemplary embodiments of the subject-matter of the invention are explained in more detail below with reference to the purely diagrammatic drawing, in which.

DESCRIPTION OF THE PREFERRED EMBODIMENTS

Figure 1:
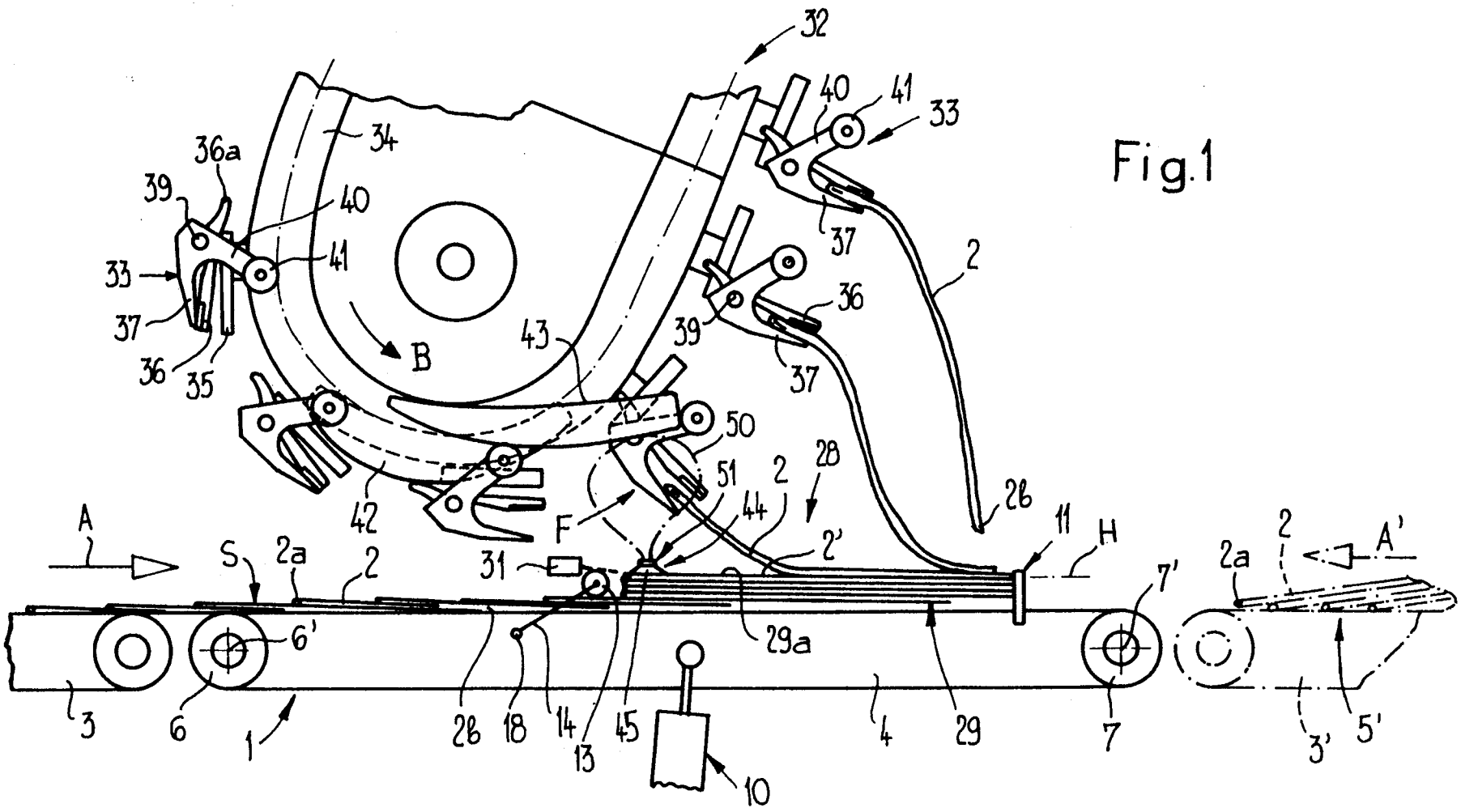
FIG. 1 shows a first embodiment of an apparatus according to the invention in side view.
Figure 2:
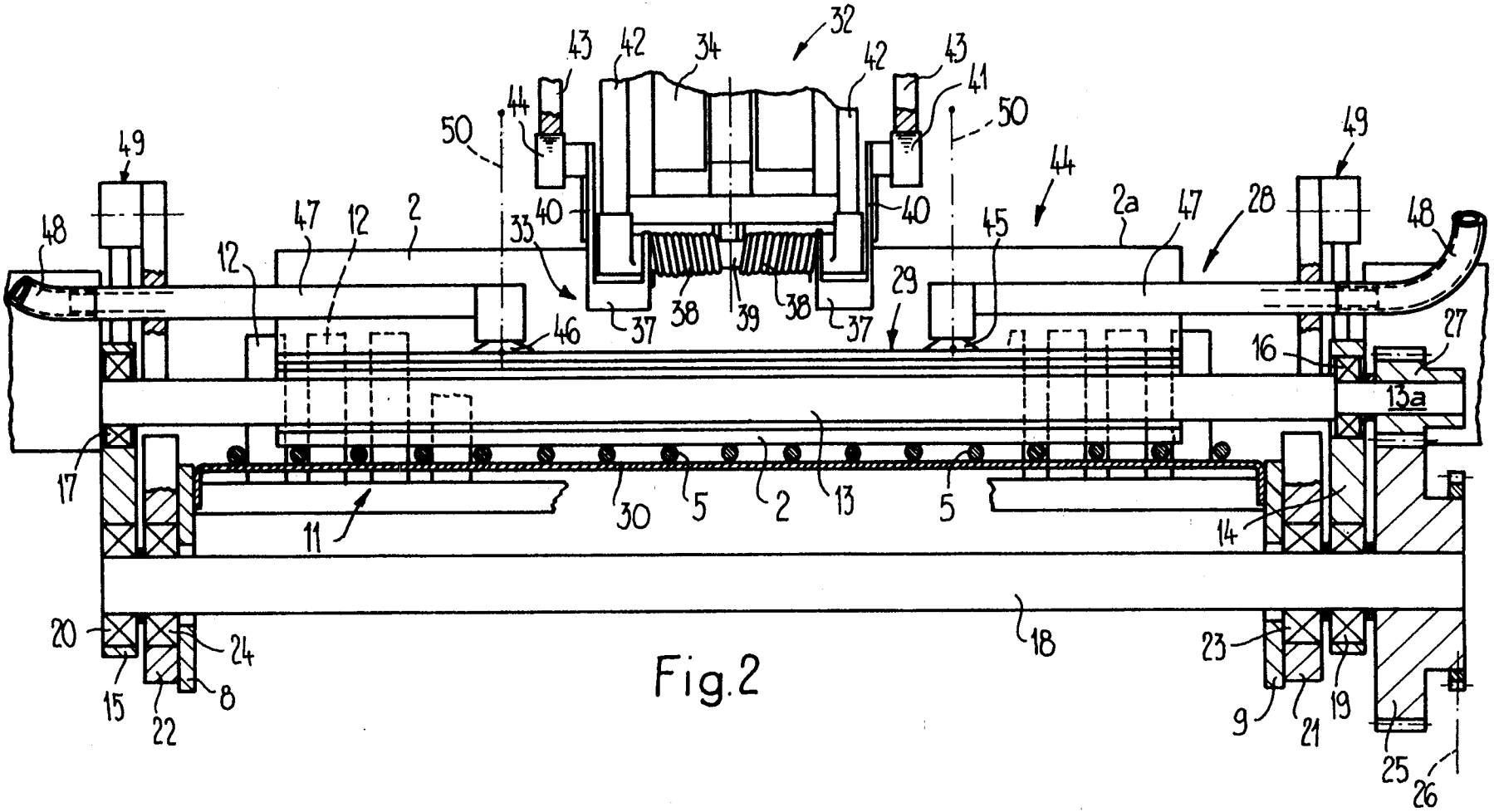
FIG. 2 shows, on an enlarged scale in comparison with FIG. 1, the apparatus according to FIG. 1 partly in cross section and partly in the form of a view.
Figure 3:
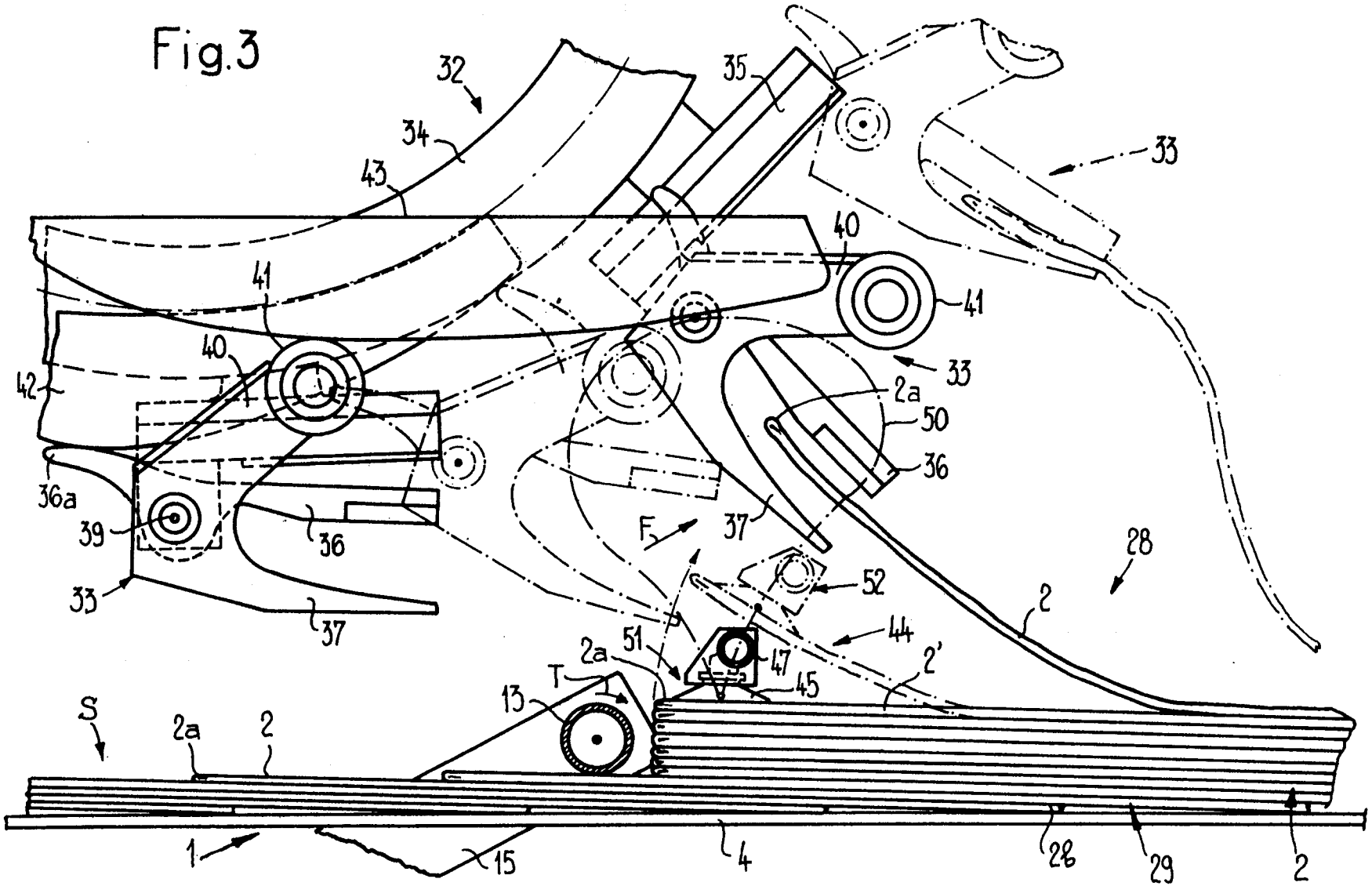
FIG. 3 shows a cutout from FIG. 1, representing the region of the intermediate stack of the apparatus according to FIG. 1, on an enlarged scale and in side view.

With reference to FIGS. 1–3, a first embodiment of an apparatus according to the invention is now described. This apparatus has a first conveying device 1, which delivers folded printing products 2 in an imbricated formation S. In this case, each printing product in this imbricated formation S rests on the following product 2. This means that, seen in conveying direction A of the conveying device 1, the trailing edge 2*a* of the printing products 2 lies upward in the imbricated formation S. In the case of the exemplary embodiment shown in FIGS. 1–3, this trailing edge of the folded printing products 2 is formed by the fold edge 2*a*. The open side edge 2*b* opposite this fold edge 2*a* accordingly forms the leading edge.

The conveying device 1 has a belt conveyor 3 as well as a strap conveyor 4 arranged downstream of the latter. The strap conveyor 4 is formed by a number of round straps 5 (FIG. 2) which run parallel to one another and at a distance from one another and are led over deflecting rollers 6 and 7, of which the one deflecting roller is driven. The belt conveyor 3 and the strap conveyor 4 may have the same or a different conveying speed. The deflecting rollers 6, 7 are mounted rotatably in two arms 8, 9 (FIG. 2) running parallel to each other. The strap conveyor 4 is designed as a rocker which can pivot about the axis 6' of the deflecting roller 6 and is supported on a piston-cylinder unit 10, only diagrammatically represented in FIG. 1. By means of said unit, the pivoting position of the strap conveyor 4 is set in a way still to be described.

Arranged above and in the end region of the strap conveyor 4 is a stop 11, which has a number of stop fingers 12 (FIG. 2) which are arranged at a distance from one another and extend through in each case between two round straps 5. Seen in conveying direction A, ahead of the stop 11 there is provided a conveying roller 13, which extends transversely to the conveying direction A and rests on the imbricated formation S. This conveying roller 13 is mounted rotatably at each of both ends in an arm 14 and 15, respectively, by means of bearings 16, 17 (FIG. 2). The arms 14, 15 are for their part mounted at the other end on a shaft 18, to be precise by means of self-aligning bearings 19, 20. The shaft 18 passes through the arms 14, 15 of the strap conveyor 4 and is mounted in bearing parts 21, 22, which are attached to the arms 14 and 15, respectively (FIG. 2). The mounting of the shaft 18 is performed by means of bearings 23 and 24. At one end of the shaft 18 there is seated on the latter a gearwheel 25, which is driven by a drive (not shown) by means of a drive chain 26. This gearwheel 25 meshes with a gearwheel 27, which is fixedly seated on a continuation 13*a* of the conveying roller 13. By means of the chain 26 and the gearwheels 25, 27, consequently the conveying roller 13 is driven in a circulating manner in the direction of the arrow T (FIG. 3). The conveying roller 13, exerting a conveying action on the printing products 2, can, thanks to its self-aligning mounting, adapt itself to the changing height of the imbricated formation S. Since, as described, the two bearing arms 14, 15 for the drive roller 13 are mounted in a self-aligning manner independently of each other, the conveying roller 13 can also adapt itself when there occur in the imbricated formation differences in thickness in a direction running transversely to the conveying direction A.

Between the conveying roller 13 and the stop 11 there is established a stacking point 28, at which the printing products 2 are piled up to form an intermediate stack 29. Arranged in the region of this intermediate stack 29 is a supporting plate 30 (FIG. 2), which is arranged underneath the round straps 5 and which has the effect of preventing the round straps 5 being able to sag under the weight of the intermediate stack 29.

As FIGS. 1–3 reveal, the printing products 2 are pushed by the strap conveyor 4 from below into the intermediate stack 29. The driven conveying roller 13 thereby assists the pushing of the printing products 2 into the intermediate stack 29. The advancing movement of the printing products 2 is braked by the stop 11.

A height monitoring arrangement, which may be designed for example as a light barrier, is represented purely diagrammatically by 31 (FIG. 1). This height monitoring arrangement 31 is connected to a control arrangement (not shown), which controls the cylinder-piston unit 10 and consequently controls the pivoting position of the strap conveyor 4. By means of this height monitoring arrangement 31 it is ensured that the upper side 29*a* of the intermediate stack 29 is always at about the same level H. This is achieved by the strap conveyor 4 being pivoted upward or downward by means of the piston-cylinder unit 10 in the event of a changing height of the intermediate stack 29, in order to keep the upper side 29*a* of the stack at the desired height H.

Arranged above the strap conveyor 4 is a second conveying device 32, which has individually controllable grippers 33 which are fastened at regular intervals on an endlessly circulating chain (not shown) which is guided in a chain channel 34. The chain, and consequently also the grippers 33, circulate in the direction of the arrow B (FIG. 1). Each gripper 33 has a carrying element 35 which is fastened to the chain and on which a clamping plate 36 and two clamping fingers 37, interacting with the latter, are pivotally mounted. As FIG. 2 shows, the two clamping fingers 37, arranged at a distance from each other, are under the action of a closing spring 38, which presses the clamping finger 37 against the clamping plate 36 and consequently keeps the gripper 33 closed. The two closing springs 38 are arranged on a bolt 39, which is mounted in the carrying element 35 and about the longitudinal axis of which the clamping plate 36 is freely pivotable together with the assigned clamping fingers 37. Connected to each clamping finger 37 is a control arm 40, which bears a control roller 41 on its end. The clamping plates 36 are provided with a lug 36*a* which, seen in conveying direction B, faces to the rear and is intended to interact with a positioning slotted link 42. When the lug 36*a* runs up onto the positioning slotted link 42, the clamping plate 36, and with it the clamping fingers 37, are brought into a certain position, in which the grippers 33 can also be opened. Serving for this purpose is an opening slotted link 43, which interacts with the control roller 41 and effects a lifting off of the clamping fingers 37 from the clamping plate 36, against the force of the closing springs 38.

In order to bring the printing products 2 from the intermediate stack 29 into the conveying region F of the conveying device 32, i.e. into the path of movement of the opened grippers 33, a sucker arrangement is provided, designated quite generally by 44. This has two suction heads 45 and 46 (FIG. 2), which are arranged at a distance from each other and each of which is fastened on a tubular carrying arm 47. Connected to each carrying arm is a connecting hose 48, which is connected to a vacuum source (not shown), which can be periodically cut in and out. Each carrying arm 47 is further connected to a drive 49, which is only partially represented in FIG. 2 and will be explained in further detail with reference to FIGS. 4 and 5. By this drive 49, the suction heads 45, 46 are moved along a closed, approximately pear-shaped circulating path 50. As FIG. 2 shows, the circulating paths 50 run to the sides of the conveying device 32. Each circulating path 50 runs from a take-over point 51, which is located on the upper side 29*a* of the stack in the region of the trailing fold edge 2*a* of the printing products 2, upward to a delivery point 52 and then further upward and in the form of a loop back again to the take-over point 51. During the movement of the suction heads 45, 46 from the take-over point 51 to the delivery point 52, the suction heads 45, 46 are connected to the vacuum source. This means that the respectively uppermost printing product 2′ in the intermediate stack 29 is seized in the region of the fold 2*a* by the suction heads 45, 46 and taken along upward into the conveying region F of the conveying device 32. The fold edges 2*a* of the printing products 2, lifted off upwardly by the suction heads 45, 46, are consequently brought into the path of movement in each case of an open gripper 33 and arrive between the clamping plate 36 of the latter and the clamping fingers 37 lifted off said plate. In order to permit this introduction of the fold edge regions of the printing products 2 into the open grippers 33, the grippers 33 are brought into the suitable pivoting position by means of the positioning slotted link 42. As can be seen in particular from FIG. 3, the clamping plate 36 is pivoted with the clamping fingers 37 by means of the positioning slotted link 42 during the taking over of the printing products 2, in order that a satisfactory seizing of the printing products 2 in the region of their fold 2*a* by the grippers 33 is ensured.

Since the two suction heads 45 and 46 are driven by mutually separate drives, it is possible to move the two suction heads 45, 46 not only synchronously with each other but also alternatively in a push-pull manner. In the case of such a solution, a printing product would then be seized and transported in each case only by one suction head 45 or 46. Each suction head 45, 46 then has to seize only every second printing product 2.

The construction and operating principle of a preferred design of the drive 49 for the suction heads 45, 46 is now described below with reference to FIGS. 4 and 5. Apart from this represented embodiment, it is of course conceivable to design this drive 49 also in another suitable way in order to move the suction head 45, 46 along the pear-shaped circulating path 50, which forms a tip at the take-over point 51.

The tubular carrying arm 47, to which the suction head 45 is attached, is fastened on one arm 53*a* of a two-armed lever 53, the other arm 53*b* of which is angled off with respect to the arm 53*a*. The arm 53*b* forms the connecting rod of a crank-and-rocker mechanism 54 and is connected via a link 55, the link pin of which is designated by 55*a*, to a crank 56. The latter is seated on a shaft 57, which is driven in a rotating manner in the direction of the arrow D and is mounted rotatably in a bearing 58. The shaft 57, the longitudinal axis of which is designated by 57′, is driven by a drive mechanism (not shown). At the other end, the arm 53*b* of the lever 53 is connected via a link 59, the link pin of which is designated by 59*a*, to a rocker 60. The latter is fastened on a shaft 61, which is mounted freely rotatably in a bearing 62. The longitudinal axis of the shaft 61 is designated at 61′.

Figure 4:
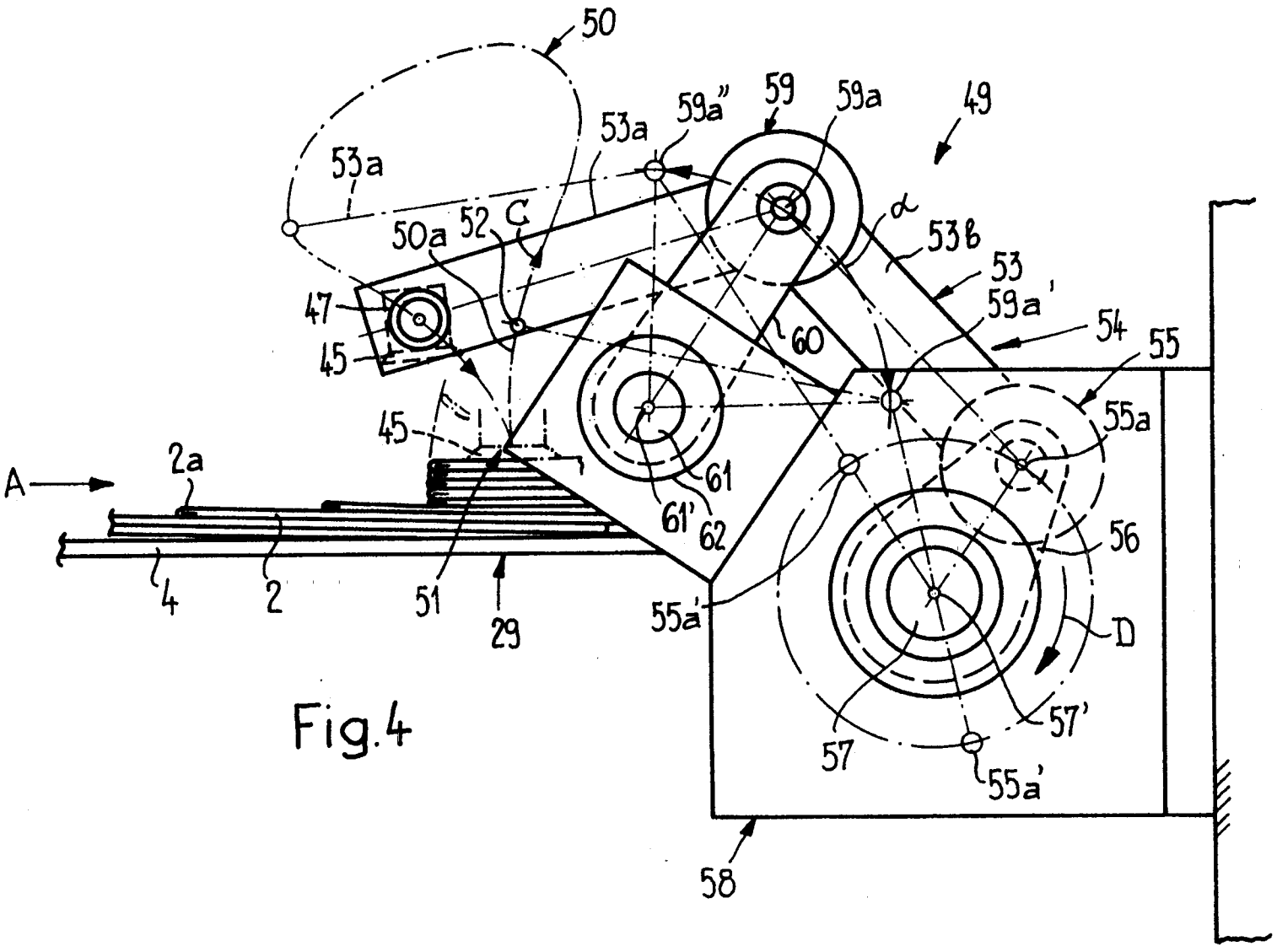
FIG. 4 shows, in side view, the drive mechanism for the sucker arrangement of the apparatus according to FIGS. 1–3.
Figure 5:
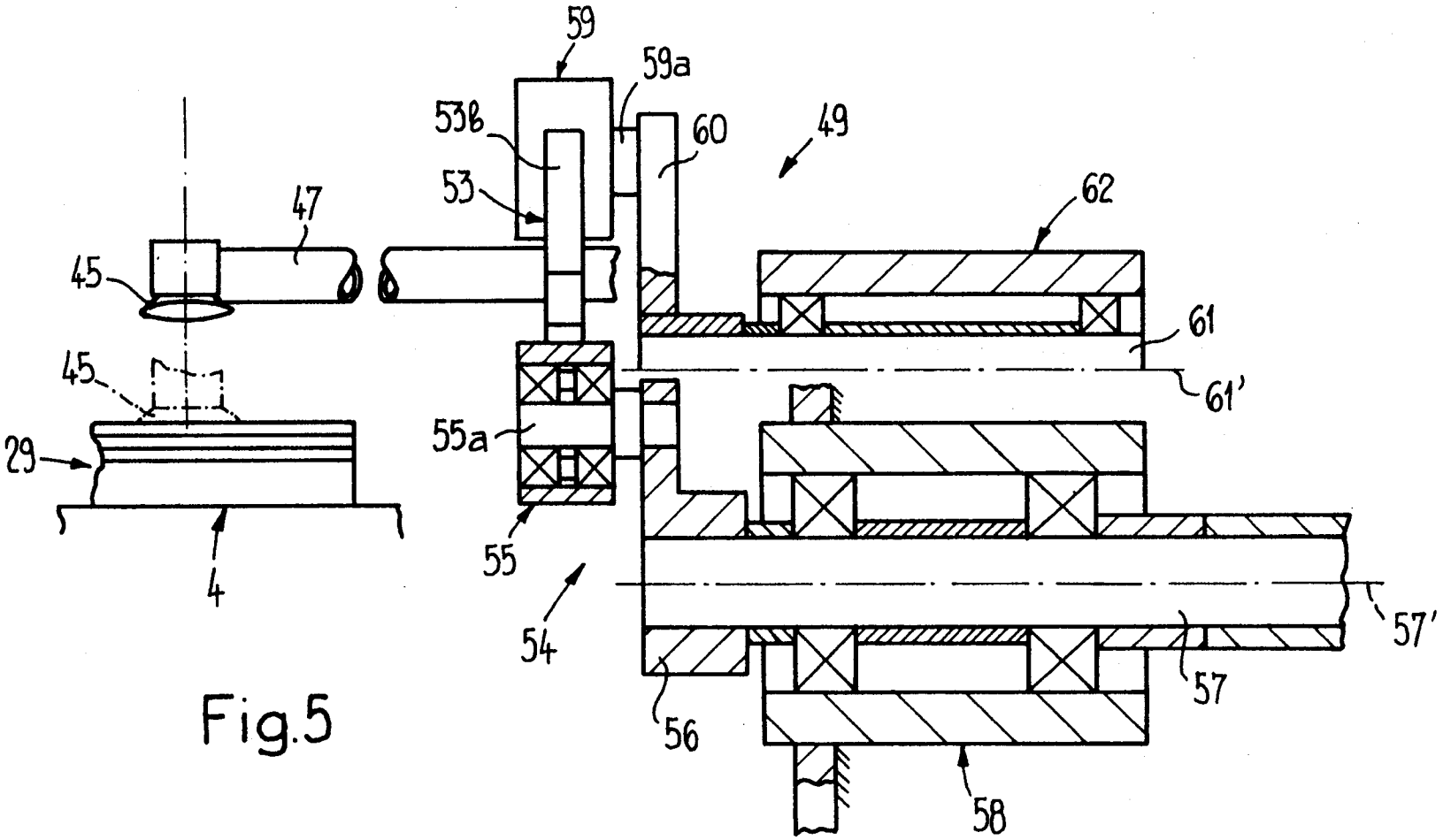
FIG. 5 shows the drive mechanism according to FIG. 4 in cross section.

When the crank 56 rotates, the rocker 60 is pivoted back and forth between two end positions, which are represented by dashed lines in FIG. 4 and form an angle $\alpha$. The two end positions of the rocker 60 are denoted by the positions of the link pin 59*a*, which are designated by 59*a*′ and 59*a*″, respectively. The positions of the link pin 55*a* assigned to these end positions 59*a*′ and 59*a*″ are designated by 55*a*′ and 55″*a*.

By means of the lever drive 49 described, the suction head 45 is then moved from the take-over point 51 along the suction 50*a* of the circulating path 50 upward to the delivery point 52. Between take-over point 51 and delivery point 52, the suction head 45 is, as already mentioned, connected to the vacuum source and takes with it a printing product 2. Once the vacuum source has been cut out, the printing product is released. The suction head 45 is moved further in the direction of the arrow C along the circulating path 50, until it again reaches the take-over point 51, where the next printing product 2 is seized. It is obvious that the circulating path 50 is chosen in such a way that, after release of the printing product 2, the suction head 45 runs around it, so that the seizing of the printing product by the grippers 33 is not hindered by the suction head movement.

There now follows an explanation of the operating principle of the apparatus described above as far as this has not already been revealed by the foregoing remarks.

The printing products 2 fed by the belt conveyor 3 in imbricated formation S are conveyed with the fold edge 2*a* trailing to the stacking point 28 and, at this point, pushed with the assistance of the conveying roller 13 into the intermediate stack 29 from below. The respectively uppermost printing product 2 in the intermediate stack 29 is seized by the suction heads 45, 46 in the region of the fold edge 2*a* and lifted off the intermediate stack 29 from above. The fold edge 2*a* is brought into the path of movement of the open grippers 33 and firmly clamped between the clamping plate 36 and the clamping fingers 37. The closing of the grippers 33 is performed by the closing springs 38 once the control roller 41 has run off the opening slotted link 43. The printing products 2 seized by the grippers 33 are then lifted completely off the intermediate stack 29 and taken upward to a further processing point (not shown). The open side edge 2*b* of the printing products 2, leading in the fed imbricated formation S and covered by the preceding printing product, is exposed after the taken-over by the conveying device 32, which means that an opening of the folded printing products is possible while the latter are still held by the grippers 33.

Due to the fact that the printing products fed by the belt conveyor 3 are not fed directly to the grippers 33, following one another at fixed intervals, any irregularities in the imbricated spacing, i.e. in the distances between successive printing products 2 in the imbricated formation S, as well as missing printing products 2 in the imbricated formation S have no influence on a satisfactory take-over by the grippers 33. Such regularities are compensated for by the intermediate stack 29. The in-phase feeding of the printing products 2 to the grippers 33 is performed by means of the sucker arrangement 44 and is consequently independent, within certain limits, of the feeding of the printing products 2 by the belt conveyor 3.

On the other hand, if need be it is possible without any problems to dispense with the charging of certain grippers 33 with a printing product 2, even in the case of constant delivery of printing products 2 by the belt conveyor 3. For this purpose it is sufficient to dispense with the establishing of a connection between the suction head 45, 46 and the vacuum source at a suitable point in time, so that the suction head 45, 46 performs a movement along the circulating path 50 without at the same time taking along a product 2.

In order to be able also to seize thicker printing products reliably, the sucker arrangement 44 is designed in such a way that the suction heads 45, 46 act, as described, on the printing product 2 in the region of the fold 2*a*.

If the imbricated formation S takes a different form than that shown in FIG. 1, i.e. with the fold 2*a* of the printing products as leading, downwardly lying edge, the imbricated formation S would have to be fed to the stacking point 28 from the other side. This variant is represented in FIG. 1 by dot-dashed lines on the right-hand side. The belt conveyor 3' conveys the imbricated formation S', in which each printing product 2 continues to rest on the following printing product, but the leading edge is the fold edge 2*a*, in the direction of the arrow A', which is opposed to the conveying direction A of the belt conveyor 3. In the case of this variant, the sucker arrangement 44 and the conveying device 32 remain the same, but the strap conveyor 4 must be mounted pivotally about the axis 7' of the deflecting roller 7 instead of about the axis 6'. In addition, stop 11 and conveying roller 13 are to be interchanged, as is indeed obvious from FIG. 1. The seizing and delivering of the printing products 2 into the conveying region F of the gripper 33 is performed in the same way in the case of this variant as already described with reference to FIG. 1.

Figure 6:
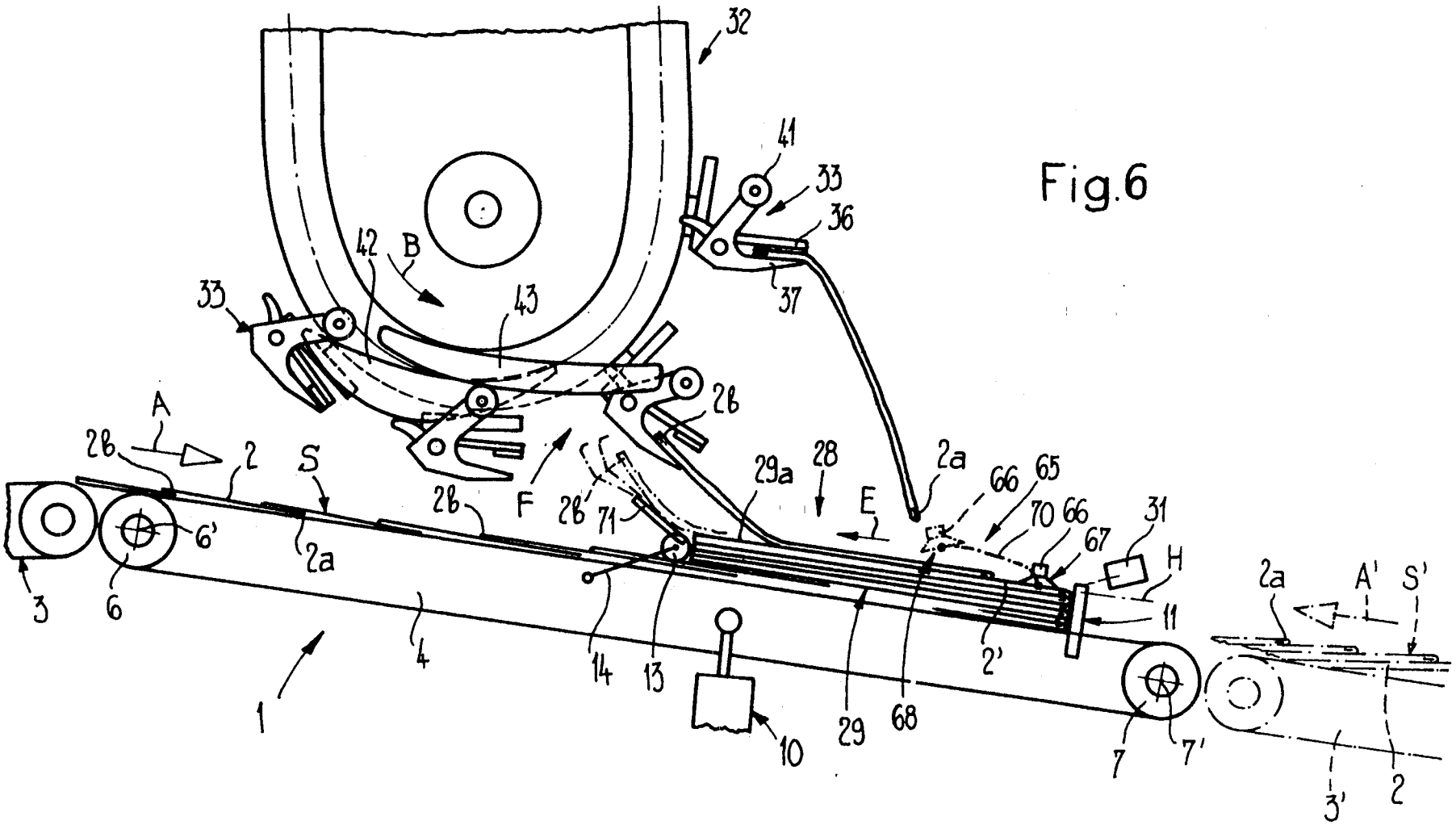
FIG. 6 shows, in side view, a second embodiment of the apparatus according to the invention.

The embodiment shown in FIG. 6 is very similar to the embodiment according to FIGS. 1–3 and differs from the latter only in a different configuration of the sucker arrangement and of the delivery of the printing products 2 from the intermediate stack 29 to the grippers 33. In this FIG. 6, the same reference numerals are used for corresponding parts as in FIGS. 1–3.

The apparatus according to FIG. 6 serves for processing printing products 2 which assume a different position within the fed imbricated formation S than in the imbricated formation S which is fed to the apparatus according to FIGS. 1–3. As can be seen from FIG. 6, it is also the case in the imbricated formation S fed from the belt conveyor 3 that each printing product 2 rests on the following printing product. Yet, in contrast to the imbricated formation S shown in FIG. 1, the leading, and consequently covered edges of the printing products 2 are formed by the fold edges 2*a*. This means that the printed products 2 have to be seized by the sucker arrangement, designated in FIG. 6 by 65, in the region of their edge 2*a* up against the stop 11. In contrast to the embodiment according to FIGS. 1–3, now however the printing products 2 are not introduced into the grippers 33 by-their fold edge 2*a* but by their opposite open side edge 2*b*.

Like the embodiment according to FIGS. 1–3, the sucker arrangement 65 has two suction heads 66, which operate synchronously or, if so required, in a push-pull manner and of which only one suction head is shown in FIG. 6. This is moved by means of a drive, still to be described in more detail, back and forth along the path of movement designated by 70 between a take-over point 67, at which it seizes a printing product 2, and a delivery point 68, at which the seized product 2 is released. During the movement from the take-over point 67 to the delivery point 68, the suction head 66 is, as already described earlier, connected to a vacuum source and lifts the uppermost printing product 2 off the intermediate stack 29 and pushes it against the feeding direction A back in the direction of the arrow E toward the conveying device 32. In order to bring the edges 2*b* of the printing products into the conveying region of the conveying device 32, i.e. into the path of movement of the open grippers 33, at the edge of the intermediate stack 29 opposite the stop 11 there is provided a directing member 71, which deflects the edge 2*b*, which is leading when the printing products 2 are being moved back, upward into the conveying region F mentioned.

Figure 8:
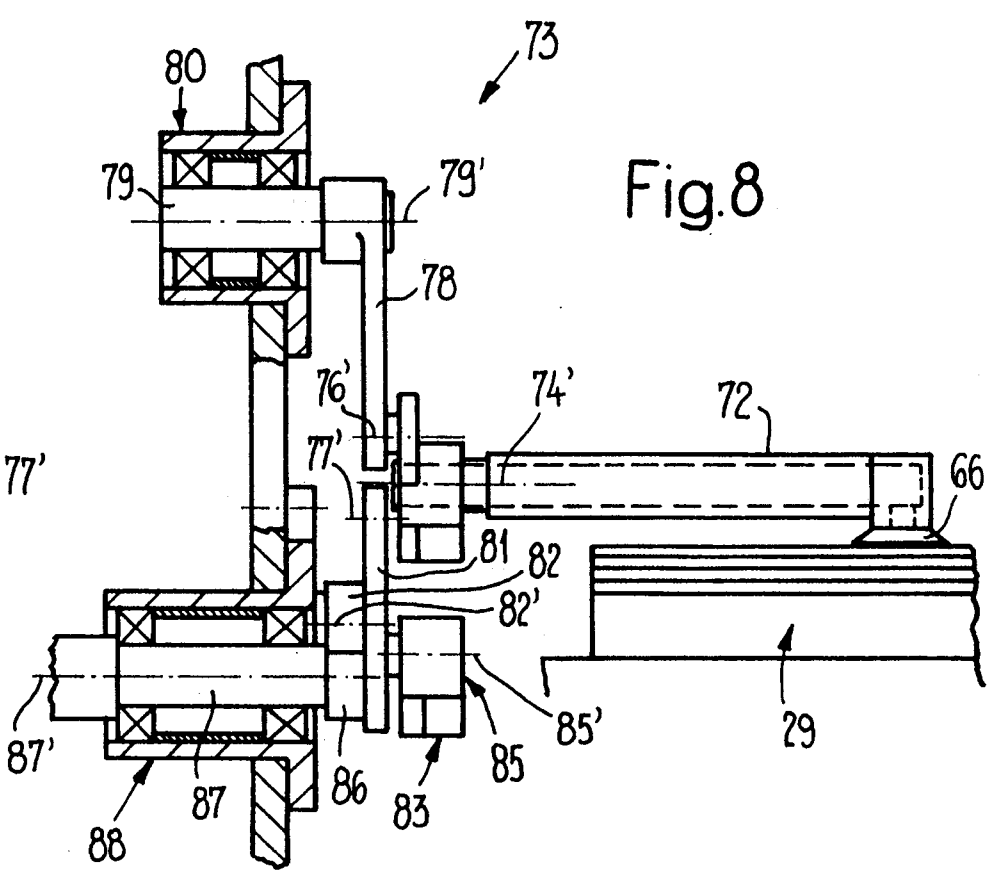
FIG. 8 shows the drive mechanism according to FIG. 7 in cross section.
Figure 7:
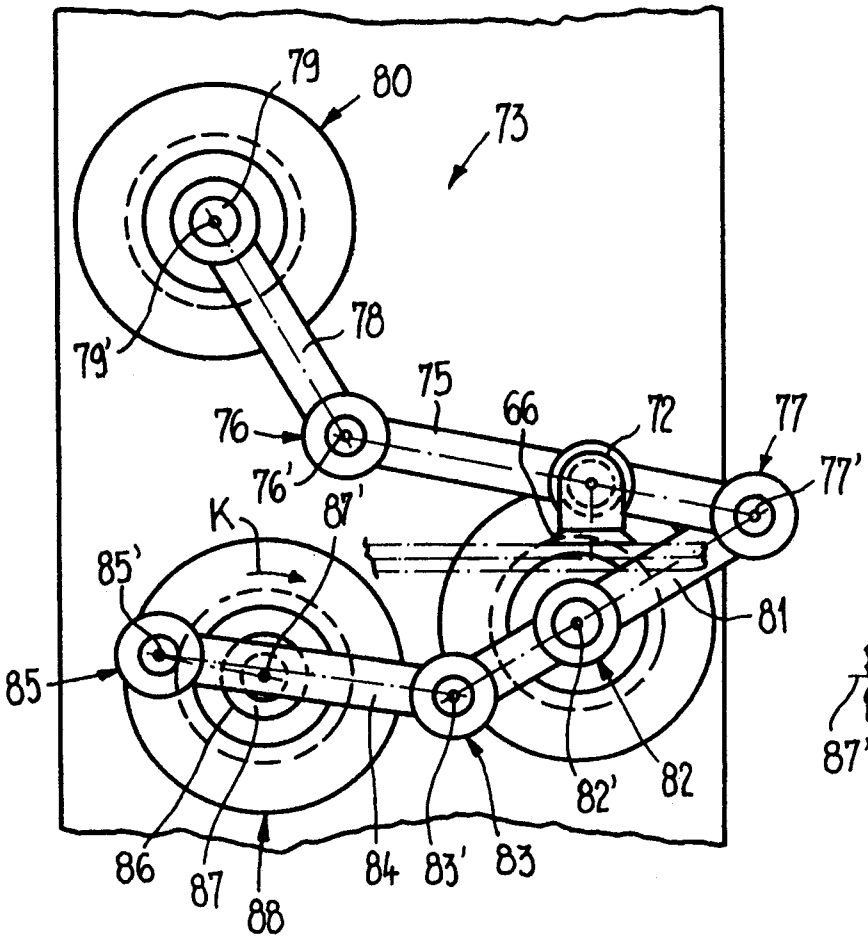
FIG. 7 shows the drive mechanism for the sucker arrangement of the apparatus according to FIG. 6 in side view.

The construction and operating principle of the drive mechanism for the suction head 66 is now explained with reference to FIGS. 7–9.

The suction head 66 is fastened on a tubular carrying arm 72, which is connected via a hose line to a vacuum source (not shown). This carrying arm 72 is connected to a drive 73, which has a lever 75 which is firmly connected to the carrying arm 72. This lever 75 is at both ends in connection with further levers via links 76 and 77. By means of the link 76, the axis of which is designated by 76', the lever 75 is connected to a lever 78, which is seated in a rotationally fixed manner on a shaft 79 with the axis 79' which shaft is mounted pivotally in a bearing 80. Via the other link 77 with the axis 77', the lever 75 is in connection with a further lever 81, which is mounted pivotally in a bearing 82. The two-armed lever 81 is connected at the other end via a further link 83 to the connecting rod 84 of a crank drive, which is connected via a link 85 to a crank 86. The latter is seated on a shaft 87 with the axis 87' which shaft is mounted in a bearing 88 and is connected to a drive (not shown). The crank 86 rotates in the direction of the arrow K.

Figure 9:
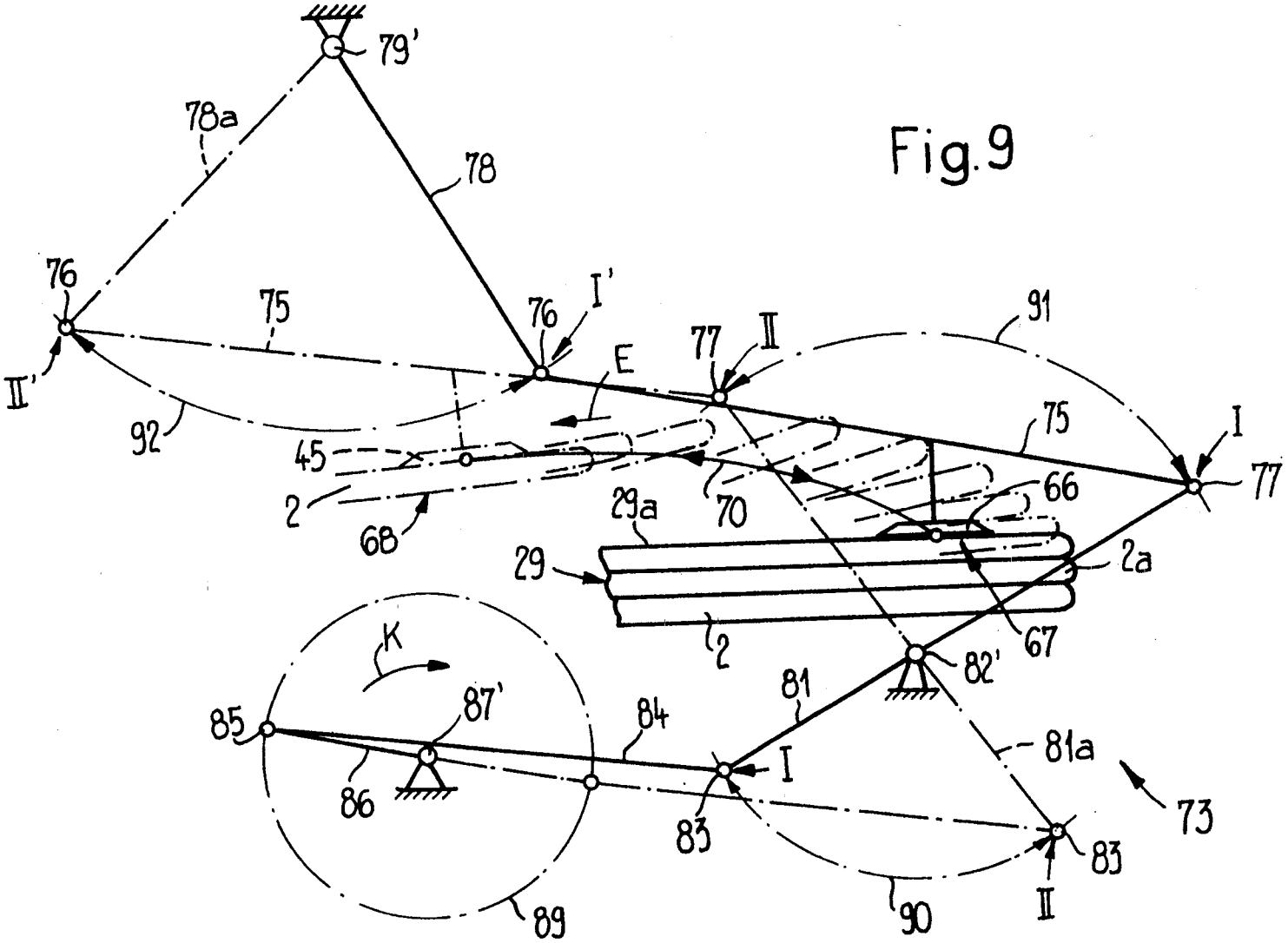
FIG. 9 shows the sequence of movements of a suction head of the sucker arrangement according to FIGS. 6–8 by way of a purely diagrammatic representation of the drive mechanism.

With reference to FIG. 9, which shows the lever gear mechanism described above only diagrammatically, the operating principle of the drive 73 is now explained.

As already mentioned, the connecting link 85 between the crank 86 and the connecting rod 84 circulates along a circular path 89. The lever 81 thereby performs a pivoting movement about the axis 82' of its bearing 82. The two end positions of the lever 81 are represented on the one hand by a solid line and on the other hand by a dot-dashed line. The two links 77 and 83 of the lever 81 thereby move back and forth along the paths 90 and 91 between the points I and II. The lever 78 pivots from the position represented by a solid line into the position 78*a*, represented by a dot-dashed line, and back again, the link 76 moving back and forth along the path 92 between points I' and II'. This pivoting movement of the levers 81 and 78 also gives rise to the movement of the lever 75, to which the carrying arm 72 of the suction head 66 is fixedly attached. The suction head 66 is consequently moved from the take-over point 67 along the slightly curved path of movement to the delivery point 68 and on the same path back again to the take-over point 67.

On the right-hand side of FIG. 6 there is indicated by dot-dashed lines, in a manner comparable to FIG. 1., a variant in which the belt conveyor 3' conveys the imbricated formation S' to a stacking point 28 in a direction A' which is opposed to the conveying direction A of the belt conveyor 3. This variant is used is in the fed imbricated formation S' the fold edge 2*a* if the trailing, upperlying edge. Just as described with reference to FIG. 1, in the case of this variant the stop 11 and the conveying roller 13, the directing member 71 and the height monitoring arrangement 31 have to be interchanged. In addition, the strap conveyor 4 must be mounted pivotally about the axis 7*a* of the deflecting roller 7. In contrast, nothing about the sucker arrangement 65 has to be changed.

Figure 10:
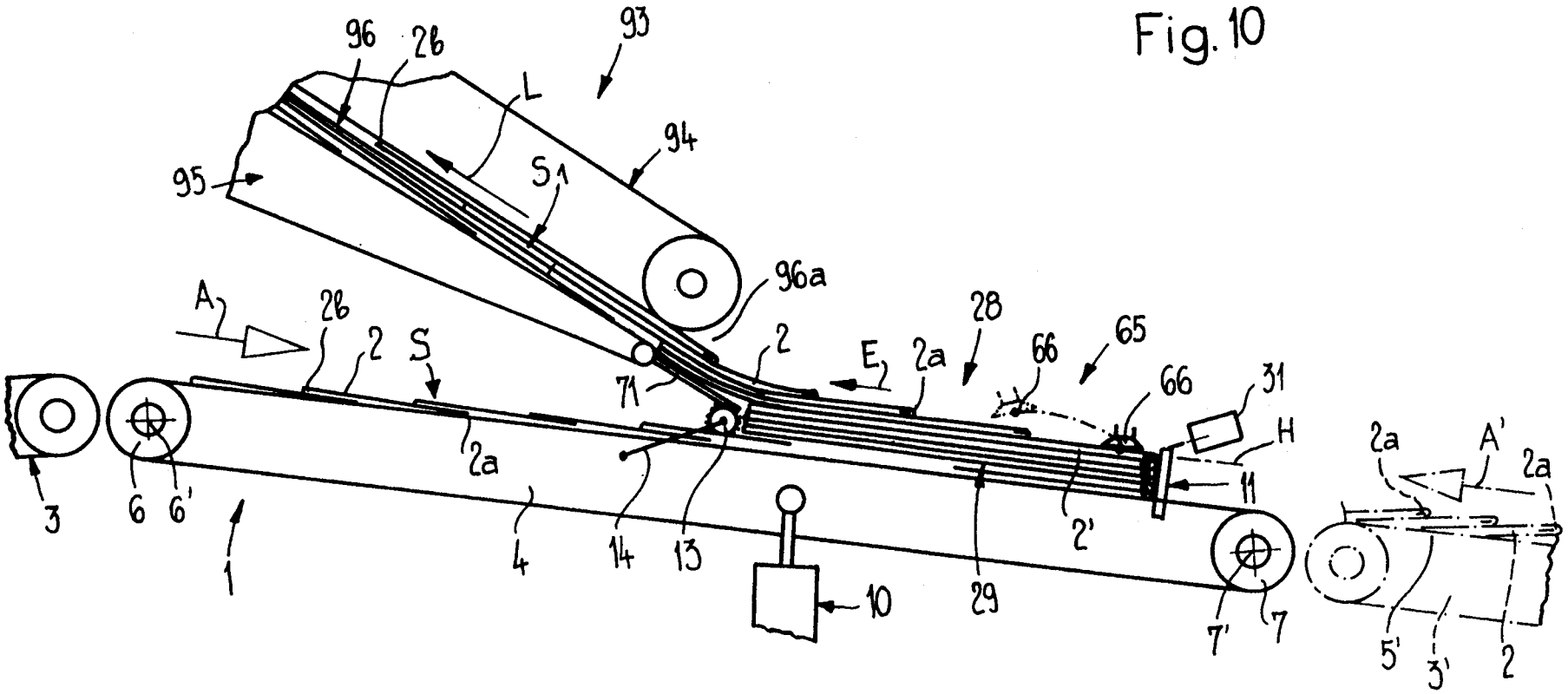
FIG. 10 shows a third embodiment of the apparatus according to the invention in side view.

In FIG. 10 there is also shown a third embodiment of the apparatus according to the invention, which is very similar to the embodiment according to FIG. 6 and differs from the latter only in a different design of the second conveying device.

In the case of the apparatus according to FIG. 10, instead of a conveying device 32 with individually controllable grippers 33, the conveying device 93 is formed by two belt conveyors 94 and 95, which are arranged one above the other and form between them a conveying nip 96. The conveying direction of the conveying device 93 is designated by L.

The respectively uppermost printing product 2 in the intermediate stack 29 is lifted slightly off the stack 29 by the sucker arrangement 65, as described in conjunction with FIGS. 6–9, and pushed back in the direction of the arrow E. The in this case leading, open edge 2*b* of the printing products 2 is deflected by the directing member 71 into the run-in 96*a* of the conveying nip 96.

As FIG. 10 shows, the printing products 2 are conveyed by the conveying device 93 away again in an imbricated formation $S_1$, in which each printing product 2 rests on the following printing product. Yet, in this imbricated formation $S_1$, the leading edge 2*b* is formed by that edge which formed the trailing edge in the fed imbricated stream S.

On the right-hand side of FIG. 10 the same variant as in FIG. 6 is shown by dot-dashed lines.

In the case of all the embodiments shown, the strap conveyor 4 may run approximately horizontally (as shown in FIG. 1) or be inclined in a descending manner in the conveying direction, as represented in FIGS. 6 and 10.

I claim:

1. A process for delivering printing products to a further processing point comprising the steps in which the printing products are fed by a first conveying device in an imbricated formation, in which each printing product rests on a following one, and are taken over and further conveyed by a second conveying device to a further processing point, wherein, before being taken over by the second conveying device, the fed printing products are pushed one after the other into an intermediate stack from below, and wherein the intermediate stack has a bottom and a top, and an uppermost printing product at the top is kept substantially at a predetermined height by lowering or raising the bottom of the intermediate stack, and in each case the uppermost printing product of the intermediate stack is seized by a sucker arrangement and brought thereby into a conveying region of the second conveying device.

2. The process as claimed in claim 1, wherein, in the case of folded printing products, the latter are seized by the sucker arrangement in the region of their fold.

3. The process as claimed in claim 1, wherein the printing products are seized in the region of an edge and brought upward into the conveying region of the second conveying device.

4. The process as claimed in claim 1, wherein the printing products are seized in the region of an edge and moved in a direction opposed to the conveying direction of the first conveying device into the conveying region of the second conveying device.

5. An apparatus for delivering printing products to a further processing point, comprising a first conveying device for feeding the printing products in an imbricated formation, in which each printing product rests on the following one, and a second conveying device for further transporting the fed printing products to a further processing point, which apparatus has a stacking point which is arranged in a conveying region of the first conveying device and at which an intermediate stack, charged from below, is formed from the fed printing products and supported on an adjustable rest, control means connected with the adjustable rest for setting an upper side of the intermediate stack essentially at a predetermined height by lowering or raising the adjustable rest in the event of a change of height of the intermediate stack, and a sucker arrangement which acts on an uppermost printing product of the intermediate stack for raising a respectively seized .printing product from the intermediate stack and delivering the same into a conveying region of the second conveying device.

6. The apparatus as claimed in claim 5, wherein the stacking point is formed by a stop which is arranged in the conveying path of the first conveying device and is for the leading edges of the fed printing products.

7. The apparatus as claimed in claim 5, wherein the adjustable rest for the intermediate stack is formed by a rocker which is pivotal about an essentially horizontal axis and is connected to the control means having a drive which is controlled by a height monitoring control.

8. The apparatus as claimed in claim 5, wherein the sucker arrangement has at least one suction head which can be connected periodically to a vacuum source and can be moved by means of a drive from a take-over point, at which the respectively uppermost product of the intermediate stack is seized, to a delivery point, at which the seized product is delivered to the second conveying device, and back to the take-over point.

9. The apparatus as claimed in claim 8, wherein the drive for the suction head moves the latter in a direction along a closed path.

10. The apparatus as claimed in claim 9, wherein the drive has a crank-and-rocker mechanism, the connecting rod of which has a preferably angled-off extension arm, to which the suction head is attached.

11. The apparatus as claimed in claim 8, wherein the drive for the suction head moves the latter back and forth between two positions along essentially the same path.

12. The apparatus as claimed in claim 11, wherein the suction head is fastened on a lever which is connected in a linked manner at one end to a pivotally mounted rocking lever and at the other end to a likewise pivotally mounted further lever, which is coupled to a crank drive which drives the latter back and forth in a rocking manner.

13. The apparatus as claimed in claim 5, wherein the sucker arrangement acting in the region of an edge, of the respectively uppermost printing product of the intermediate stack raises the seized product upward and brings it into the conveying region of the second conveying device.

14. The apparatus as claimed in claim 5, wherein the sucker arrangement acting in the region of an edge, of the respectively uppermost printing product of the intermediate stack moves the seized product, with its opposite edge ahead, away from the intermediate stack into the conveying region of the second conveying device.

15. The apparatus as claimed in claim 5, wherein the second conveying device has individually controllable grippers which are fastened at intervals on a circulating drawing member and wherein the sucker arrangement brings the seized printing products with an edge region into the path of movement of the opened grippers.

16. The apparatus as claimed in claim 5, wherein the second conveying device has a belt conveyor which, at least in the run-in region of the printing products fed by the sucker arrangement, is assigned a conveying member which forms with the belt conveyor a conveying nip for the printing products.

* * * * *